US005522145A

United States Patent [19]

Chisum

[11] Patent Number: 5,522,145

[45] Date of Patent: Jun. 4, 1996

[54] CENTERLINE GAUGING SYSTEM WITH FLOATING POINTER FOR VEHICLE ALIGNMENT EQUIPMENT

[76] Inventor: F. Lavell Chisum, Rte. 5, Box 267, Claremore, Okla. 74017

[21] Appl. No.: 212,103

[22] Filed: Mar. 11, 1994

Related U.S. Application Data

[63] Continuation-in-part of Ser. No. 936,137, Aug. 27, 1992, Pat. No. 5,355,711, and a continuation-in-part of Ser. No. 120,902, Sep. 13, 1993, Pat. No. 5,417,094.

[51] Int. Cl.[6] ..... G01D 5/00; G01D 21/00

[52] U.S. Cl. ..... 33/288; 33/608

[58] Field of Search ..... 33/288, 608

[56] References Cited

U.S. PATENT DOCUMENTS

| | | | |
|---|---|---|---|
| 3,869,804 | 3/1975 | Friend | 33/288 |
| 4,015,339 | 4/1977 | Horvallius | 33/608 |
| 4,319,402 | 3/1982 | Martin | 33/180 AT |
| 4,321,754 | 3/1982 | Colby | 33/203.2 |
| 4,329,784 | 5/1982 | Björk | 33/180 AT |
| 4,442,608 | 4/1984 | Clausen | 33/288 |
| 4,490,918 | 1/1985 | Clausen | 33/288 |
| 4,561,187 | 12/1985 | Powell | 33/608 |
| 4,691,443 | 9/1987 | Hamilton et al. | 33/288 |
| 4,719,704 | 1/1988 | Hogg | 33/608 |
| 4,731,936 | 3/1988 | Aldrich et al. | 33/608 |
| 5,058,286 | 10/1991 | Chisum | 33/608 |
| 5,355,711 | 10/1994 | Chisum | 33/608 |
| 5,417,094 | 5/1995 | Chisum | 33/608 |

FOREIGN PATENT DOCUMENTS

| | | | |
|---|---|---|---|
| 165115 | 7/1987 | Japan | 33/608 |

OTHER PUBLICATIONS

"Operating Procedures and Owners Manual", Continental Collision Repair Systems, Alexandria, Minnesota, 1990. No month.

"Continental—The Company of Great Choice", Catalog 150154/5M, Continental Collision Repair Systems, Alexandria, Minnesota, 1987. No month.

*Primary Examiner*—Thomas B. Will

*Attorney, Agent, or Firm*—Head, Johnson & Kachigian

[57] ABSTRACT

A gauging tool used in measuring the extent of damage and needed repair to restore the vehicle frame/body to the original manufacturer's specification. The tool is especially useful with a frame repair machine by making the treadway that supports the vehicle as the datum plane and centerline from which all measurements are taken. The gauges use floating pointers which provide an immediate indication of the damage.

5 Claims, 11 Drawing Sheets

CENTERLINE GAUGING SYSTEM WITH FLOATING POINTER FOR VEHICLE ALIGNMENT EQUIPMENT

RELATED APPLICATION

This application is a continuation-in-part of applications Ser. No. 07/936,137, filed Aug. 27, 1992, now U.S. Pat. No. 5,355,711 and Ser. No. 08/120,902, filed Sep. 13, 1993, U.S. Pat. No. 5,417,094.

BACKGROUND OF THE INVENTION

This invention relates to apparatus for measuring the location of reference points on a damaged vehicle and for determining the extent of deviation of such reference points on set or known standards based on the original vehicle manufacturer's specifications.

Various apparatus or equipment are known for correcting frame and body members of vehicles back to their pre-damaged positions. Equipment of this nature is utilized by personnel in body shops and other service and repair shops. Typical of such equipment is the apparatus disclosed in U.S. Pat. Nos. 3,360,066; RE 31,636; and 5,058,286, which patents are incorporated herein by reference. The effective use of such equipment in the process of applying pulling forces to a vehicle body is enhanced by various gauging and measuring systems that provide an indication of the magnitude of misalignment or deviation of component parts of the vehicle body to an operator of the alignment or restoration equipment. Typical of such measuring systems that have been disclosed in the prior art include the following: U.S. Pat. No. 4,731,936 and the references cited therein; U.S. Pat. No. 4,442,608; U.S. Pat. No. 4,329,784; U.S. Pat. No. 4,319,402; U.S. Pat. No. 4,321,754; and U.S. Pat. No. 4,490,918.

Many of the prior art measurement systems are rigidly attached to the frame straightening apparatus. Other systems use special mobile frames to support and measure each different type of vehicle with the pulling device being independent of the frame device. Other apparatus such as that manufactured by Car-O-Liner have a lower measuring system that is independent of the frame that supports the vehicle but is only usable on the supporting frame manufactured by that company and thus, it is not capable of use with any form of body and frame straightening and aligning machine. Many of the other devices used in the art are applicable in realigning the front McPherson Strut Towers and the related inner front structure of the vehicle, and requires that the lower portion of the vehicle be aligned prior to its use.

Another form of measuring system incorporates vertical scale members that extend upward from a separate measuring frame into contact with the vehicle measuring reference positions. Such a system is the Universal Measuring System manufactured by Continental Collision Repair Systems of Alexandria, Minn.

A centerline gauge is a common tool used by body and frame straightening personnel. The gauge typically includes a central body member with a vertical pointer and two spaced arms each extending outward on each side of the central body. The gauge is transversely attached to the vehicle by means to attach the free end of each arm to the vehicle at spaced but common fixturing stations, such as holes, bolts or points on the vehicle. With several of these placed along the length of the vehicle including at undamaged areas, an operator determines the damages areas by attempting to visually line up the center pointers. If they don't line up, then this indicates a damaged area or areas.

Centerline gauges are capable of being used only by highly skilled and trained technicians who are required to determine the extent of damage by visual alignment relative to centerline or other linear arranged gauge pointers. One possible problem with this system is in parallax or visual distortion caused by the dominate eye concept.

SUMMARY OF THE INVENTION

Accordingly, it is an object of this invention to provide a vehicle frame measuring apparatus which has the feature of being independent of frame and body straightening apparatus and therefore adaptable to any frame straightening system and which includes an overhead measuring system which is independent of the straightening device and for measuring effectively all of the vehicle body, frame and chassis. The device is particularly applicable to unibody vehicles.

A principal object of this invention is to provide a measuring means for damaged vehicles that utilizes the ramp or treadway of a frame repair machine as the datum from which all measurements as to the extent of the damage and the correctiveness of the repair can be made.

Another object is to provide measuring means that not only provide means to position and center a vehicle upon a repair machine ramp or treadway but also provide measurements as to the extent of the damage and needed repair.

Another object of the invention is to provide a measuring system that uses measuring gauges that 'hang down' or become floating pointers from the various vehicle measuring data points relative to fixed measuring apparatus and indicia that is a part of the frame repair machine which provides indication of damage to be repaired but also the correctiveness of the repair.

A yet further object of this invention is to provide a floating pointer system which when used in conjunction with a center line gauge or an overhead system permits an accurate determination of the extent of correction necessary to bring a particular portion of a vehicle back to its original manufacturer's specification.

Another object of the invention is to provide a centerline gauging system that uses self adjusting pointers that give an indication of damage or misalignment of a vehicle chassis or body at any given datum point of the vehicle for visual comparison relative to a given standard for a corrected vehicle at that same datum point.

Another object of the invention is to provide a centerline gauging system that hangs from the vehicle relative to a movable cross bar means on the support structure which system is used in conjunction with the gauging system to establish the amount of correction relative to a known standard for a damaged vehicle.

DETAILED DESCRIPTION OF THE PREFERRED EMBODIMENT

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

Figure 1A:
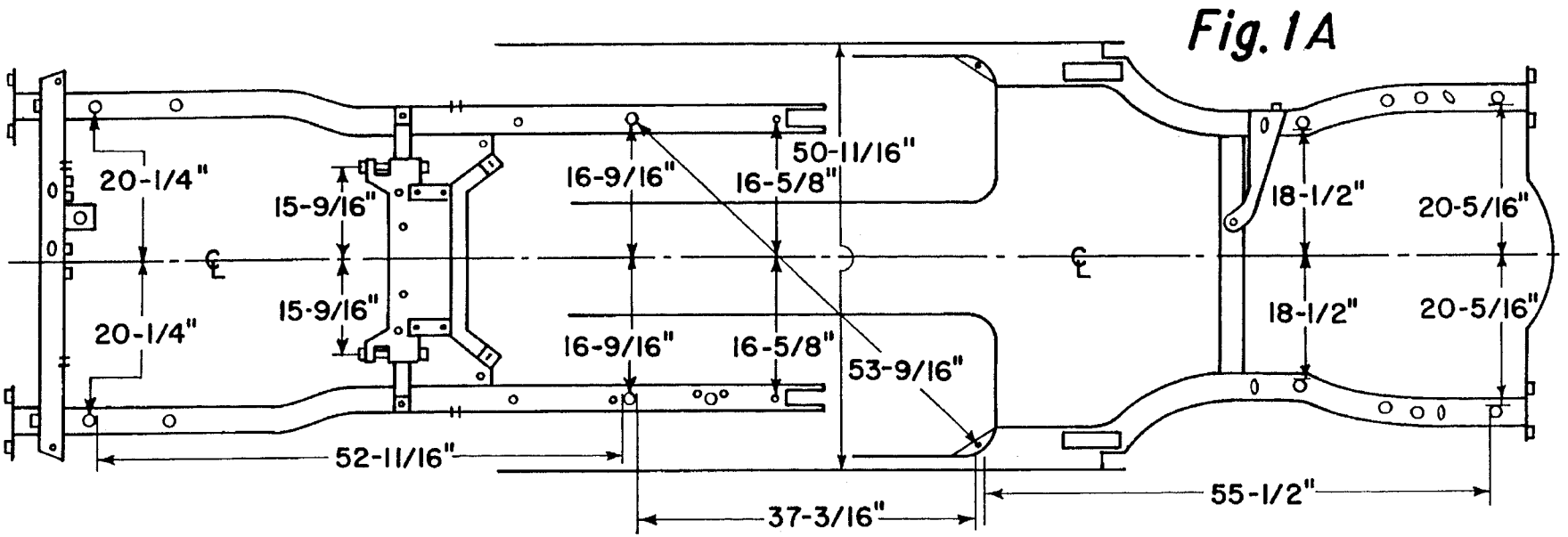
FIG. 1A is a bottom view of a vehicle chassis with correct dimensions and specifications of the vehicle as originally manufactured relative to a longitudinal centerline.
Figure 1:
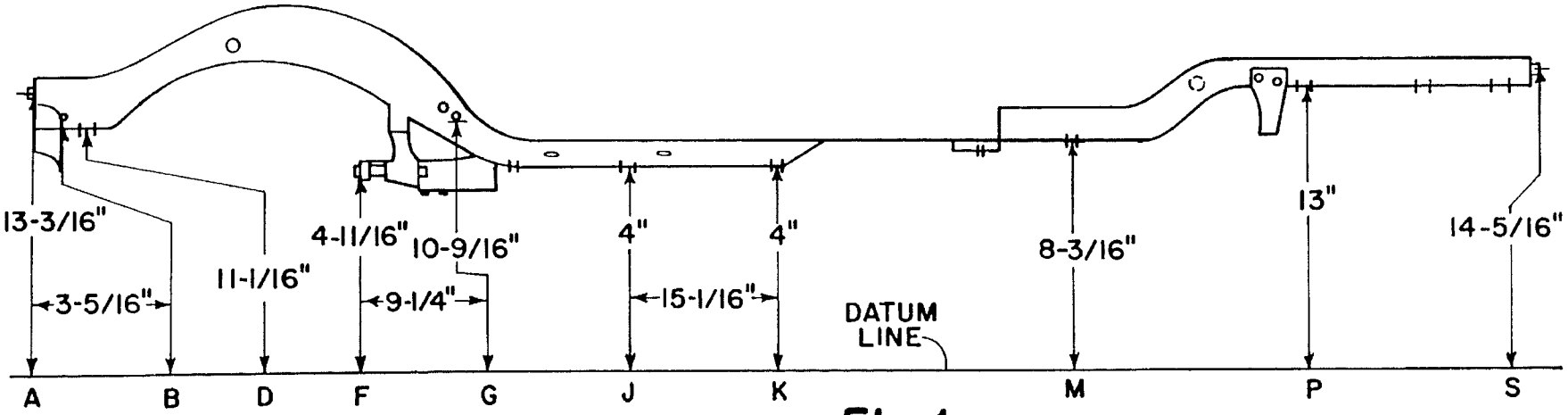
FIG. 1 is a side view of a typical vehicle dimension chart of the dimensions to variety of vehicle data points for a properly aligned vehicle as provided by a manufacturer relative to a fixed imaginary datum line.

FIGS. 1 and 1A are examples of typical vehicle chassis or body dimension charts—in this particular case a 1988 Chrysler LeBaron GTS. These dimensions and specifications are provided by the manufacturer and/or others and assembled in booklets for body and frame alignment operators. One such booklet is prepared by KLM Automotive Publishing, Inc. The measurements shown thereon are based on factory specifications, and in the case of unibody-type vehicles, were measured with the vehicle supported on the pinch welds found at the front and rear torque box areas of the vehicle. The various measuring points shown in FIG. 1 by the alphabetical letters, represent fixturing holds, bolts, nuts, studs, nonremovable plugs, rivets, and the like. The datum line is an imaginary horizontal line or plane which is established at a fixed distance below the vehicle. The datum line or plane is parallel to the vehicle's underbody and establishes perpendicular (vertical) measurements to the various fixturing locations and becomes a fixed reference plane for all height dimensions.

FIG. 1A is a drawing of the vehicle's underbody; that is, the illustration is drawn as though viewing the vehicle from underneath looking up at the underbody. In this figure dimensions are made from a longitudinal centerline plane. In both FIGS. 1 and 1A, many of the dimensions have been omitted, and these drawings are provided only as a sample of the specifications and dimensions available to the mechanics/operator for the purposes of restoring a damaged vehicle to its original configuration. It is this information that can be stored into a computer/comparator such as described in U.S. Pat. No. 5,058,286 that will allow the technician/mechanic, in the use of this invention, to determine the exact areas of the frame or body that need to be corrected, and after repair, that such corrections meet the original manufacturer's specifications.

Figure 7:
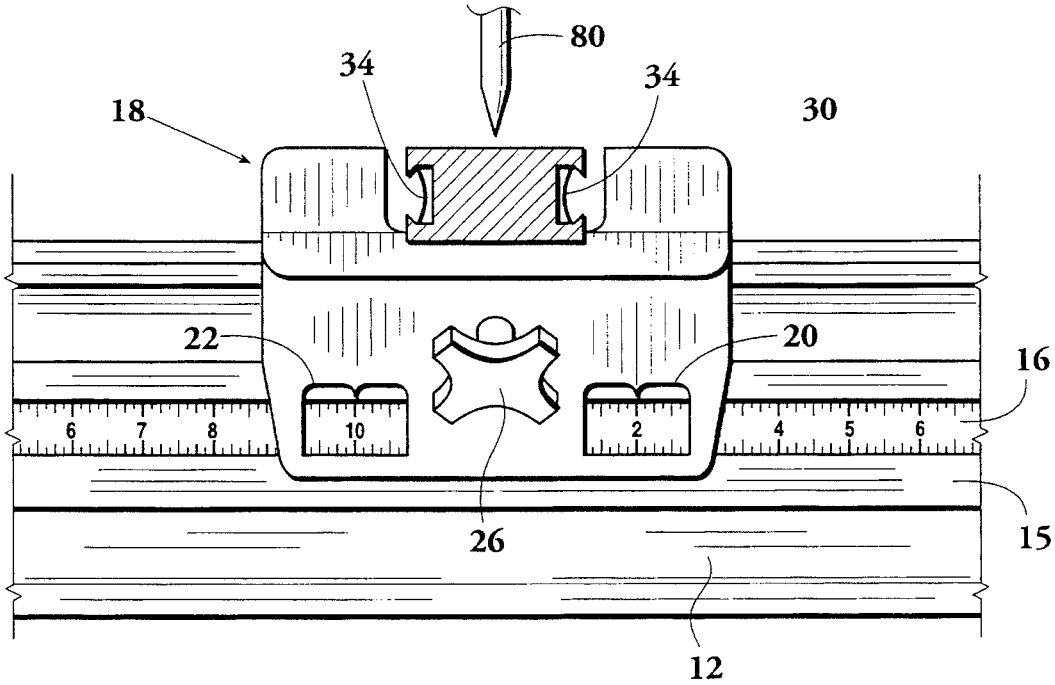
FIG. 7 is a partial section view taken along the line 7—7 of FIG. 2.

The apparatus of this invention is to be attached to a vehicle body and frame alignment machine platform system such as described in U.S. Pat. No. 5,058,286 which is incorporated herein by reference or to the machine described in U.S. Pat. Nos. 3,360,066 and Re: 31,636. Total views of the platform system and its space treadways are partially viewed. In referring to FIG. 2, the numeral 12 is a partial section of one treadway there being the mirror image 14 of same on the opposite side shown in FIG. 3. Attached to the inside of the treadway is a measuring tape holding bracket 15 which retains a measuring tape 16 which extends longitudinally along each of the treadways which provide a means, more specifically shown in FIG. 7, and described in U.S. Pat. No. 5,058,286 for the lower cross bar brackets generally indicated by the numeral 18 to be attached at a desired longitudinal measuring location. The bracket includes, as shown in FIG. 7, a measuring peep hole 20 and sight 22 for accurately positioning the bracket at the aforesaid location. The bracket includes a clamping bolt 26 which rigidly connects the bracket 18 to the inner side of the treadway 12 and likewise to the opposite treadway not shown. The bracket includes a sleeve 30 through which a lower measuring bar 32 is slidably attached and positioned transversely to the centerline of the vehicle in this embodiment. The lower measuring bar 32 includes a measuring tape 34 on at least one side and on the top of the lower measuring crossbar. Along with the tape or in lieu thereof, snap-on clips 36 and 38 (FIG. 3) may be positioned along the lower crossbar 32 which contain targets as shown in FIG. 4, where indicator pins 80 and 82 should meet.

Figure 2:
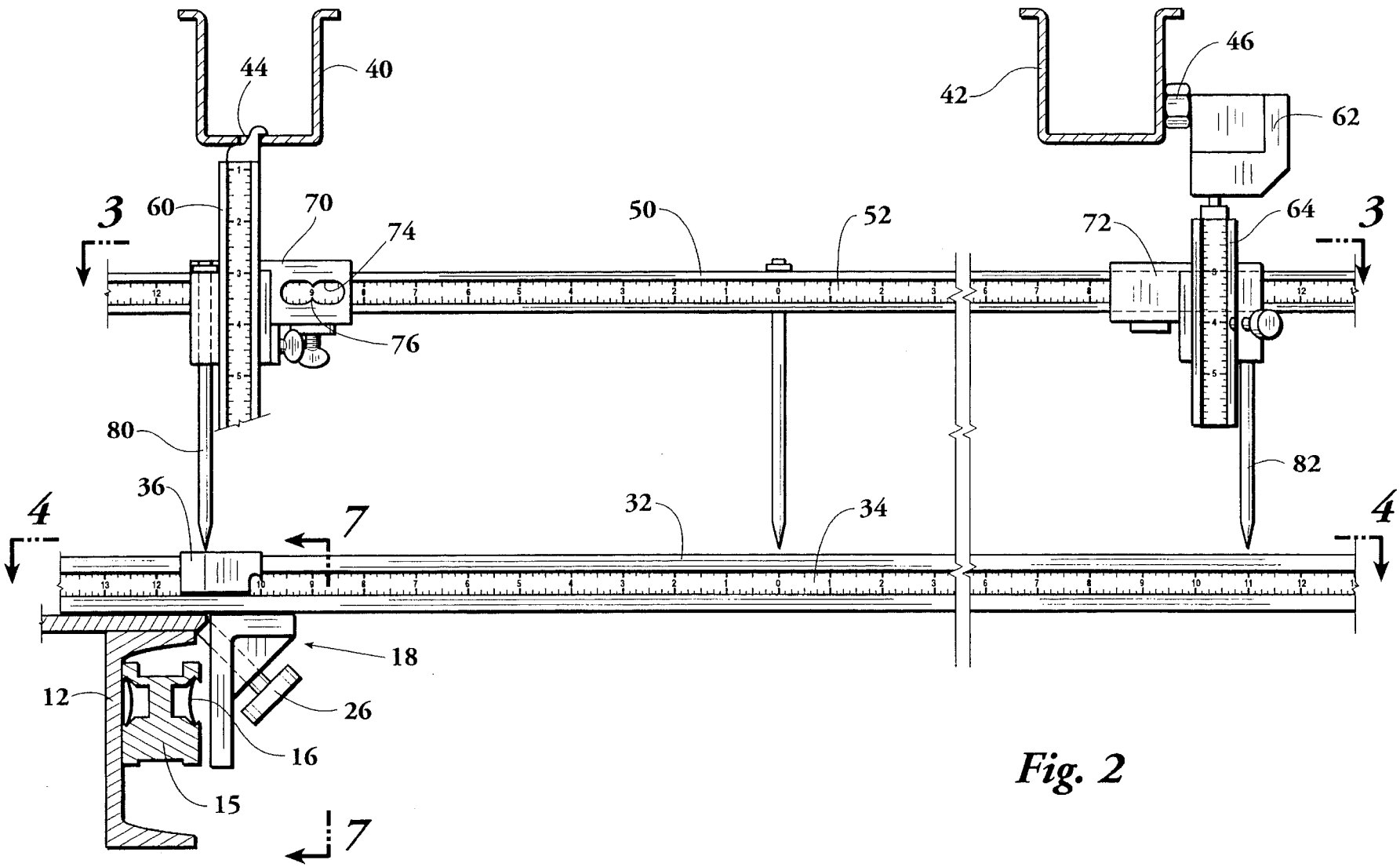
FIG. 2 is a front elevational view of measuring system of this invention.

Alternatively, any form of measuring indicia may be utilized to give the operator/mechanic the visual targets as indication of the extent of the damage and repair necessary to properly align the vehicle body. The vehicle body, in this case, is represented in FIG. 2 by right frame rail 40 and left frame rail 42. In this instance, the right vehicle frame rail 40 includes a fixturing opening 44 while the left frame rail 42 fixturing nut 46 represents a location, as for example when referring to FIG. 1, the specification shows between fixturing hole 44 and the fixturing nut 46. An upper measuring crossbar 50 includes measuring indicia 52 and, when retained on a correctly aligned vehicle, would be substantially horizontal.

Figure 2A:
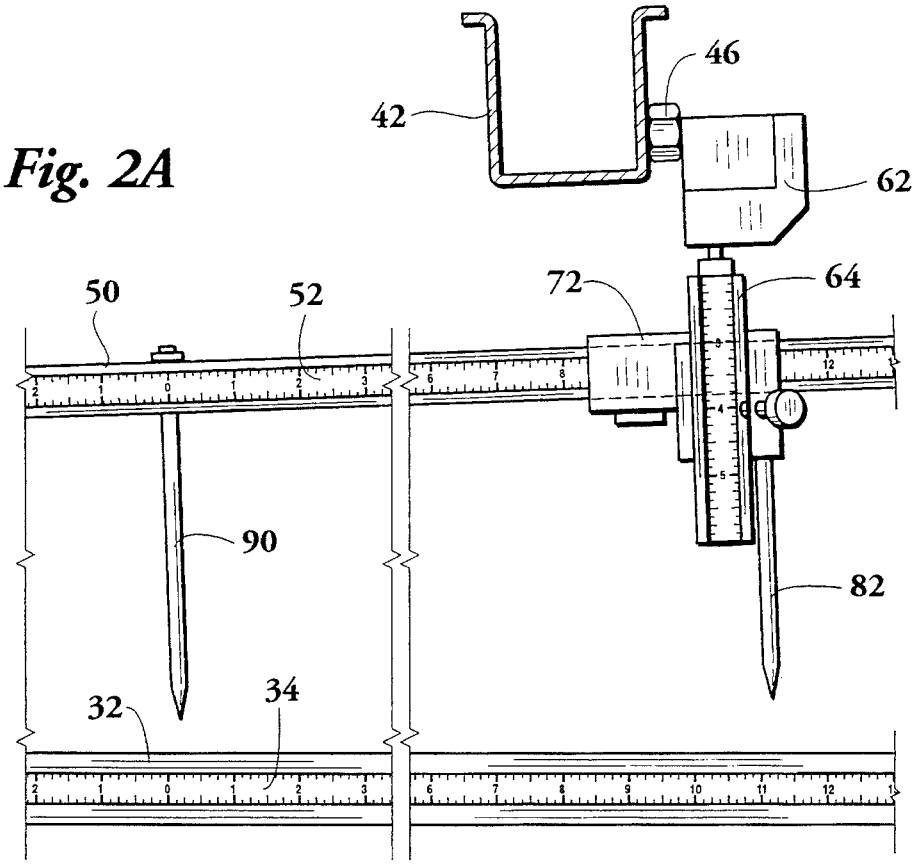
FIG. 2A is a partial front elevational view of the measuring system as it would look on a damaged vehicle.

FIG. 2A represents the position of the gauge when the vehicle frame rail 42 is bent or damaged. A datum scale 60 mechanically depends from the fixturing hole 44 on the right side of the vehicle while a magnetic forms of attachment means 62 is connected to the fixturing bolt 46 on the left side of the vehicle frame rail. Brackets 70 and 72 are connected to the respective datum scales 60 and 64 and to said upper measuring crossbar 50 as shown. Referring to FIG. 2, each bracket includes a key hole 74 and a peep sight 76 for viewing the measuring indicia tape 52 so that the bracket will be located in the proper position. The top of the upper measuring crossbar 50 in essence will become a fixed datum plane similar to the datum plane shown in FIG. 1A from which measurements can be easily made by the operator/ mechanic in repairing damaged vehicles. Floating indicator pins 80 and 82 are vertically moveable in each bracket with each pin being of a length indicative of a true distance of the fixturing location relative to said horizontal datum plane as per the manufacturer's specification and to give a visual indication of damage and the proper repair of the damaged portion which is graphically illustrated in FIG. 2A. A centerline pin 90 is provided and supported by the upper measuring crossbar 50 and is also vertically moveable within the crossbar. Each of the indicator pins 80, 82 and 90 maybe of varying lengths depending upon the measurement to be made. In the use of the invention, when the pins touch the top of the lower measuring bar, the vehicle is within specification at that position. Thus, the operator in the repair will be provided with a visual indication as the proper pulls are made to bring the frame/body back to specification. The apparatus will also provide the vehicle owner a visual guide as to the extent of the damage and confidence in the correct repair.

As shown in FIG. 2A in the event that the frame rail 42 happened to be bent upwardly relative to right side frame rail 40, the upper measuring crossbar, and associated brackets and indicator pins, would provide a view to the operator/mechanic as shown. Thus, the measuring device herein attached to the vehicle upon a frame straightening machine such as shown in U.S. Pat. No. 5,058,286 and in U.S. Pat. No. RE31,636, the operator/mechanic could view and design the repair and straightening operation to bring the measuring equipment herein to the aligned position as shown in FIG. 2.

Figure 3:
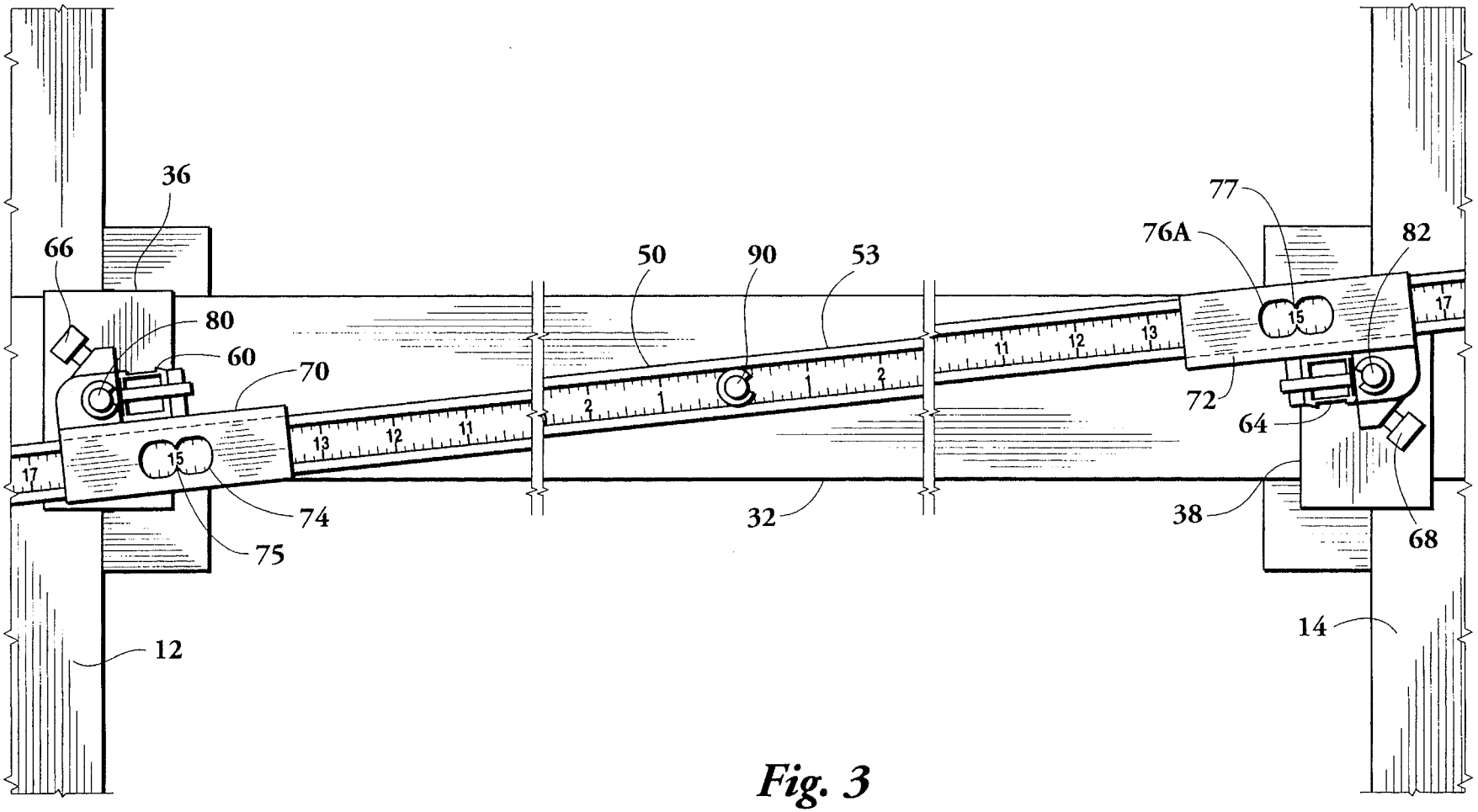
FIG. 3 is a top plan view taken along the line 3—3 of FIG. 2.
Figure 4:
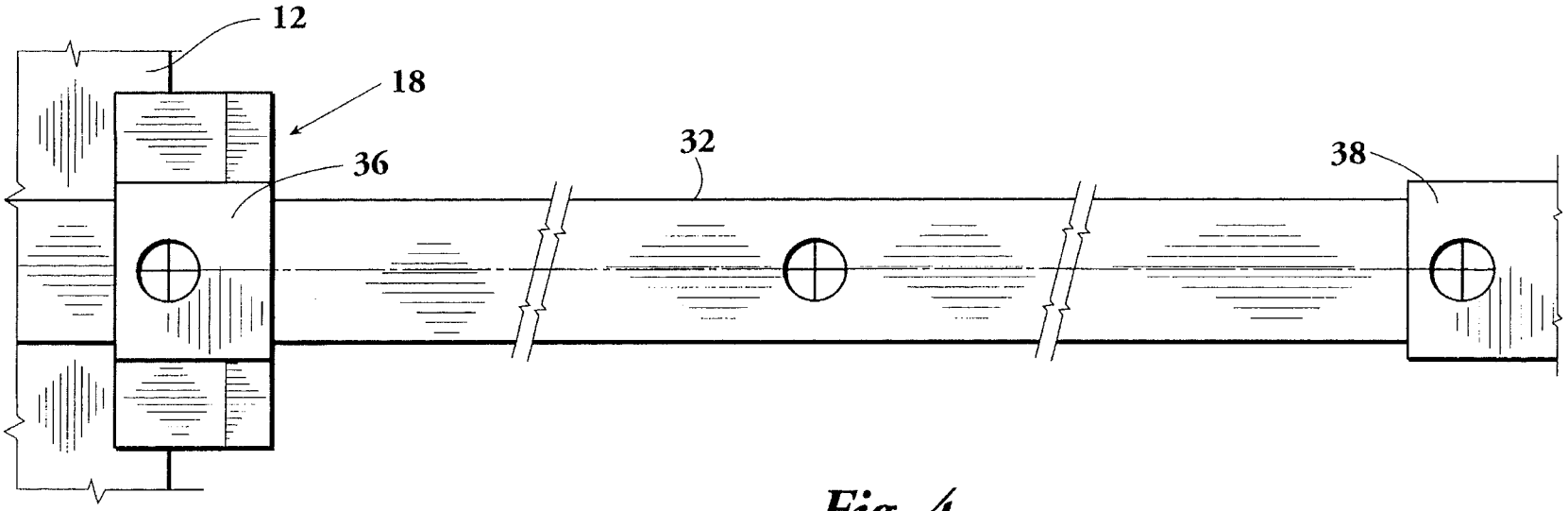
FIG. 4 is a top plan view taken along the line 4—4 of FIG. 2.

The top plan view of FIG. 3 describes the upper measuring crossbar 50 and the attachment brackets 70 and 72 being connected to the vertical datum scales 60 and 64 by clamping bolts 66 and 68. The crossbar in this embodiment is angularly offset because of the construction of bracket 70 and 72, which will place pins 80, 82 and the center pin in perpendicular alignment to the treadways 12 and 14. The top side of the upper measuring crossbar includes the measuring indicia 53 while brackets 70 and 72 contain respective key hole openings 74 and peep sights 75 while bracket 72 includes a key hole 76 and peep sight 77 for alignment with the measuring indicia 53.

Figure 5:
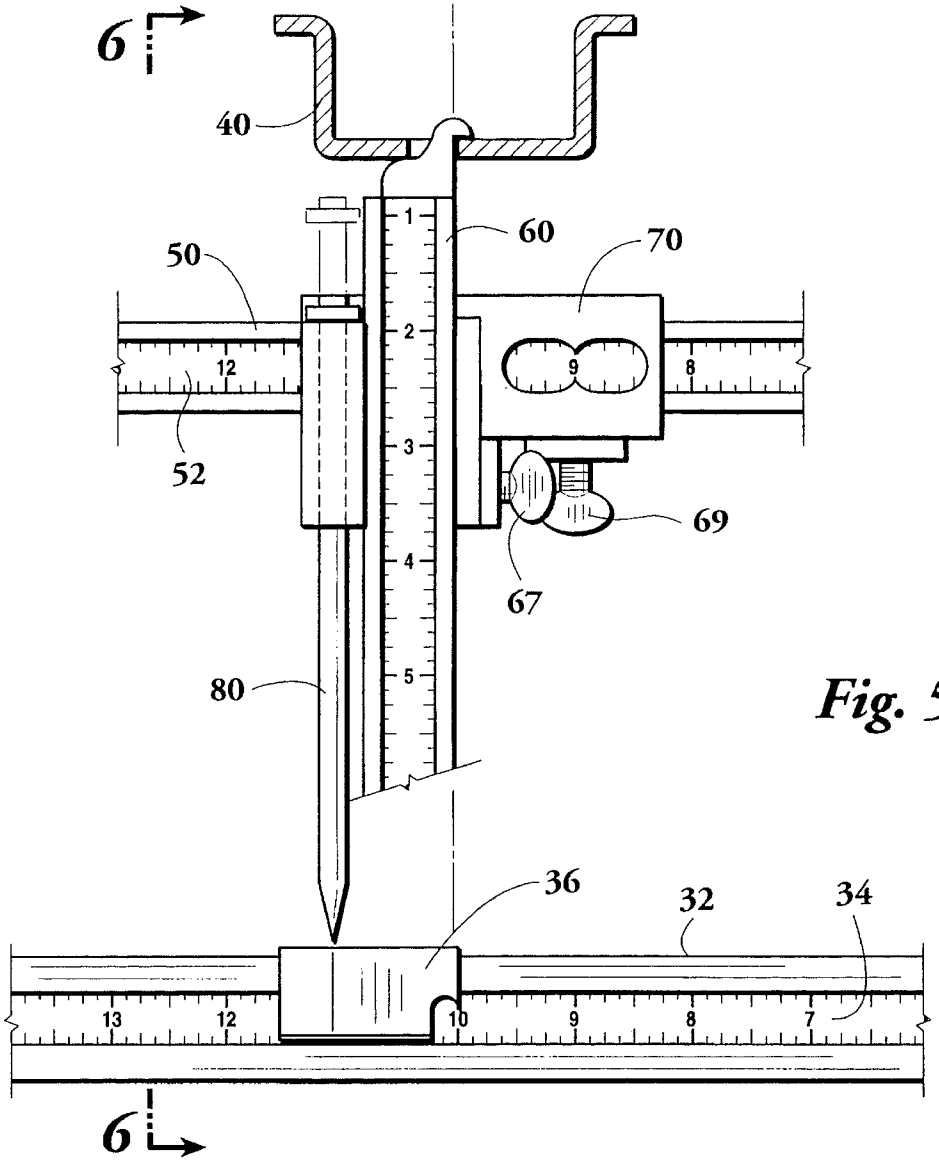
FIG. 5 is an enlargement of a floating pointer used with the measuring system in FIG. 2.
Figure 6:
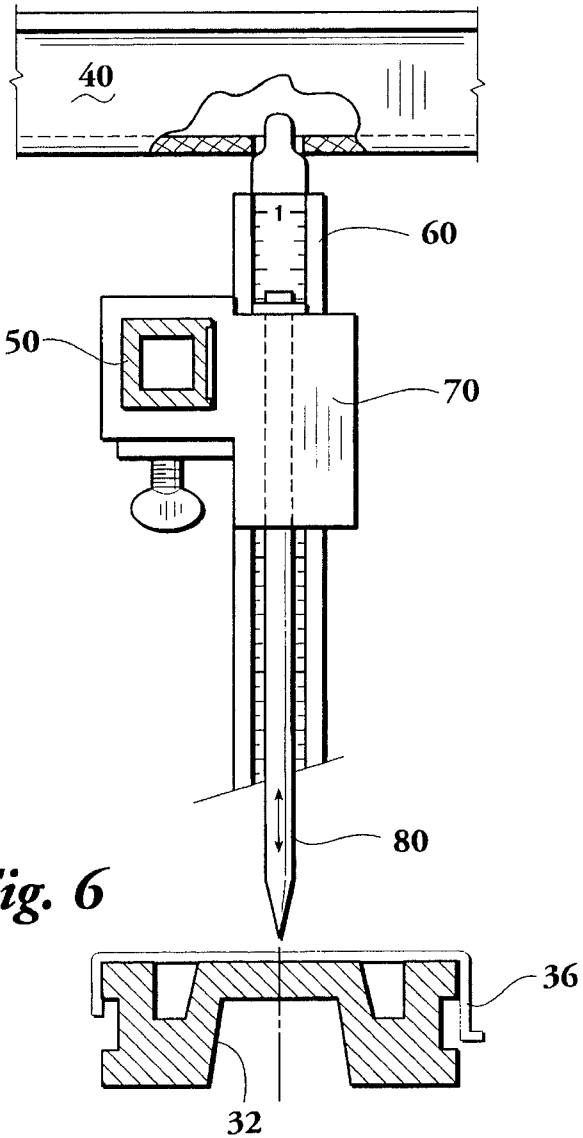
FIG. 6 is a side elevation view taken along the line 6—6 of FIG. 5.

Enlarged views of the upper measuring crossbar brackets and floating pointers are shown in FIGS. 5 and 6. The depending vertical datum scale 60 is retained to the bracket by wing nut 67 and to upper measuring crossbar by a wing nut locking system 69.

Figure 8:
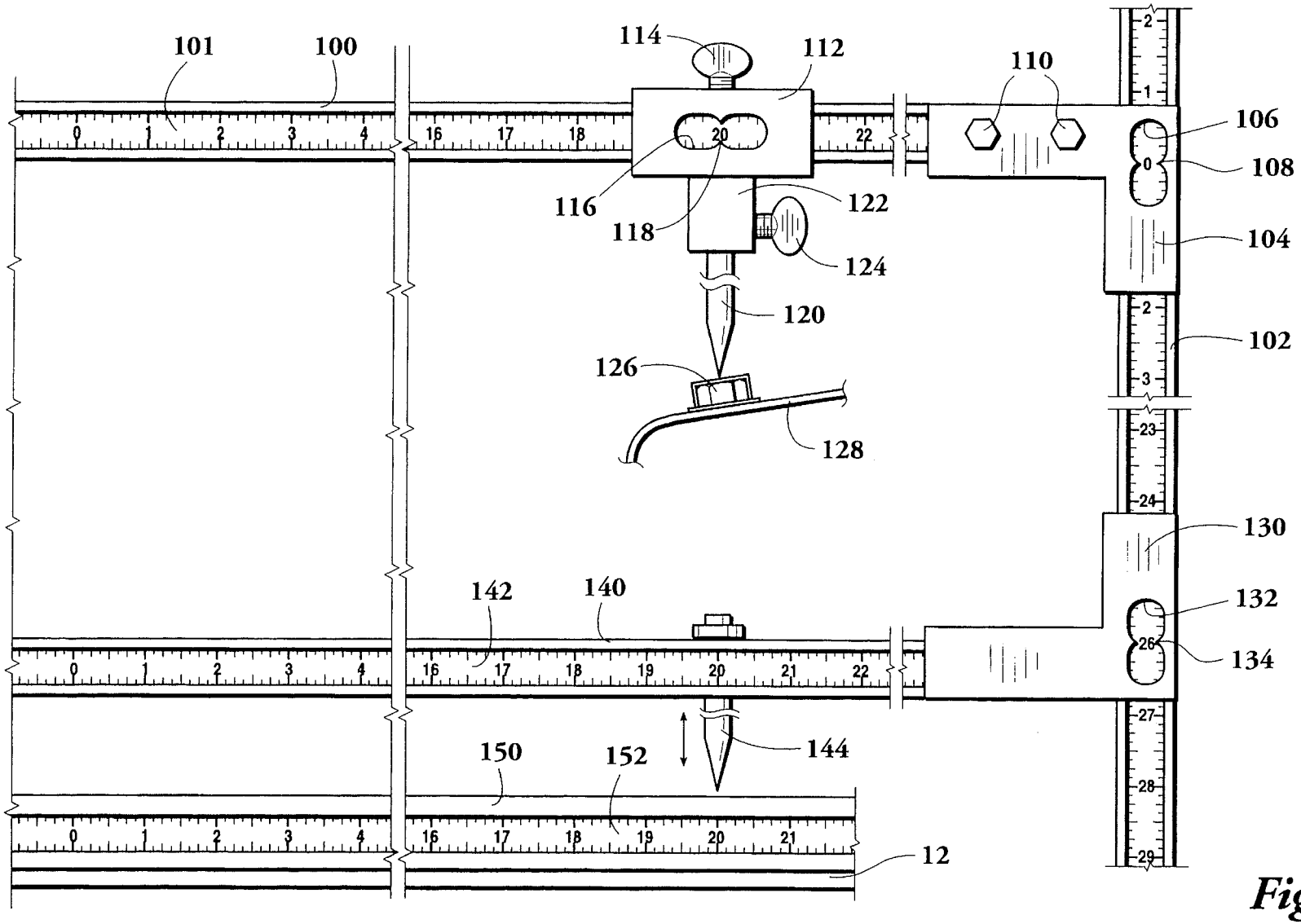
FIG. 8 is a strut tower measuring apparatus incorporating the concepts of this invention.

The system of FIG. 8 is an additional form of measuring means for correcting damaged vehicle relative to the McPherson Strut and comprises an assembly of an upper measuring crossbar 100 having measurement indicia 101 along the side and top thereof. The upper measuring crossbar is connected to spaced vertical measuring crossbars 102 of which the left side bar is not shown. The connection occurs by way of corner bracket 104 having a key hole 106 and peep sight 108, the bracket being attached to the upper measuring crossbar by bolts 110. An upper crossbar strut bracket is shown at 112 which is affixed to the upper measuring crossbar 100 by wing lock nut 114. The upper bracket includes a key hole 116 having a peep sight 118. A measuring pointer 120 is vertically adjustable within sleeve 122 of the bracket 112 and retained in position by a locking wing nut 124. The pointer is adapted to rest upon a McPherson Strut, not shown, at a nut 126 formed as a part of the strut housing 128. This system is duplicated on the left side but not shown here. A lower bracket 130 containing a key hole 132 and peep sight 134 is adapted to retain a lower measuring crossbar 140 having a measuring indicia 142 thereon. A lower measuring pointer 144 which may include a sliding bracket like 72 of FIG. 2 is attached to the lower measuring crossbar and adapted to move vertically as shown by the arrows relative to a fixed measuring crossbar 150 having indicia markings thereon at 152. This lower crossbar 150 is situated upon a treadway 12 of the body and frame straightening apparatus and machine.

Figure 10:
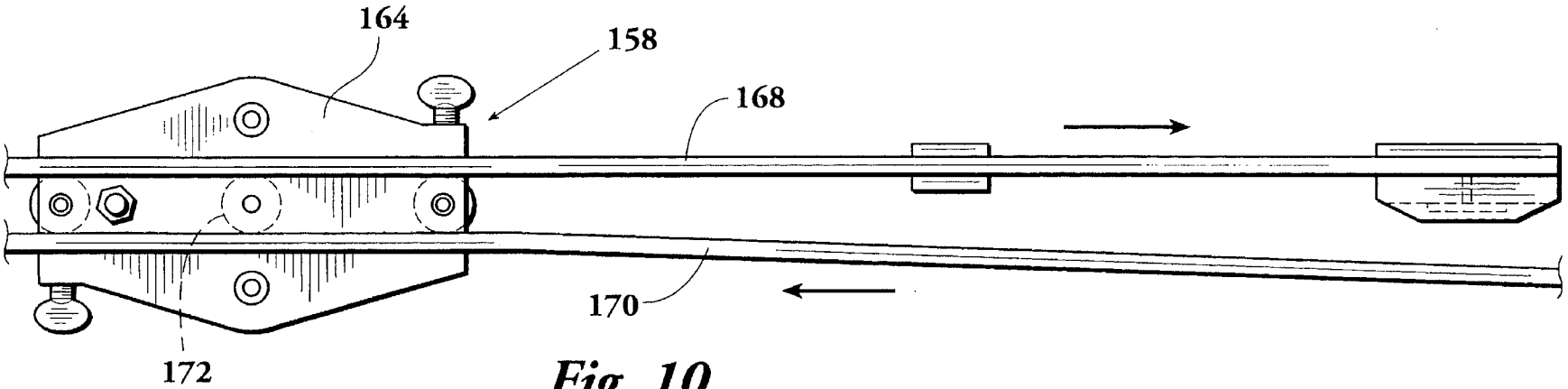
FIG. 10 is a partial top elevational view of the device of FIG. 9.
Figure 9:
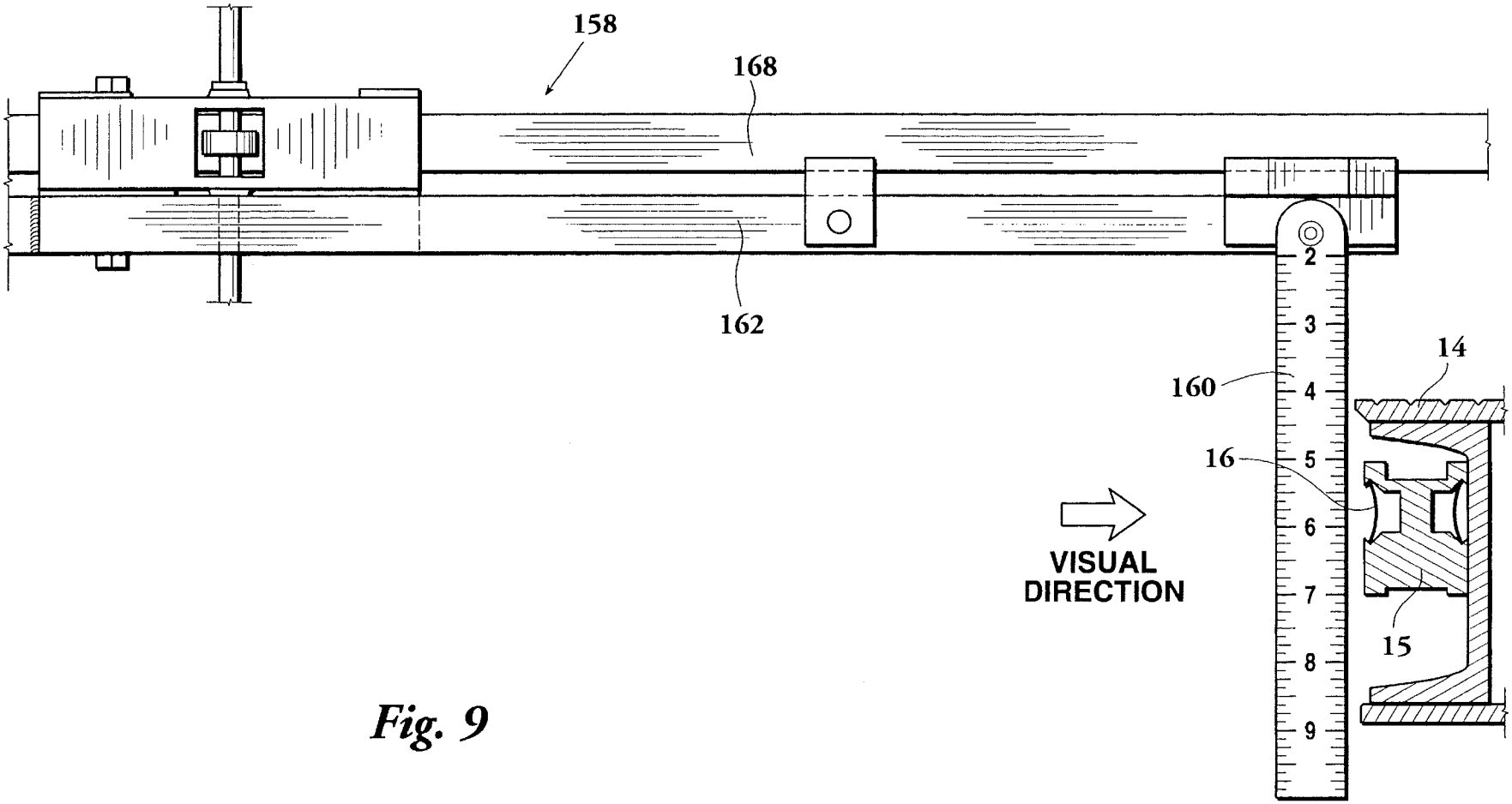
FIG. 9 is a partial front view of a centerline gauge modified with a floating measurement device of this invention.

FIGS. 9 and 10 depict a standard form of centerline gauge shown that is attached to the vehicle by any known means. A typical centerline gauge, as known in the art, is designed to hang from the vehicle and is comprised of parallel bars that move together from a center connector. They are usually used for reading vehicle frame width dimensions especially on the simpler repair jobs. Typical gauges are sold by IRONWOOD, CHIEF INDUSTRIES and MO-CLAMP. A badly damaged vehicle requires much more than width measurements to do a proper job of repair. The problem is that centerline gauges do not give the technician the capability to measure the whole car. The additions to the centerline gauge as set forth herein will permit more complex measurements.

One improvement of such a centerline gauge generally designated by the number 158 is shown in FIG. 9 by the use of a pendulum like gauging arm 160 which depends from a separate arm 162. This will permit a visual indication of the relationship of the vehicle relative to the measuring tape 16 found in the holding bracket 15, in this particular instance shown mounted upon treadway 14. Such use not only provides an indication of the vehicle being centered upon the treadway supports but will also provide an indication of the amount of damage to the vehicle at the particular point where this centerline gauge is hung. This occurs by the relationship of the pendulum gauge 160 relative to the top of the treadway 14, when compared to the mirror image gauge relative to treadway 12 on the other side.

FIG. 10 is a partial top plan view of a centerline gauge, generally 158. The gauge includes a central connector 164 and two parallel arms 168 and 170. The connector includes a roller 172, not shown in this view, which is in contact with each arm, such that when arm 168 is moved in the direction shown by the arrow, arm 170 moves in the opposite direction. The end of each arm is mounted on opposite fixturing locations. As seen in FIG. 9 separate arm 162 is attached to each moveable arm to support the hanging gauge 160.

Figure 11:
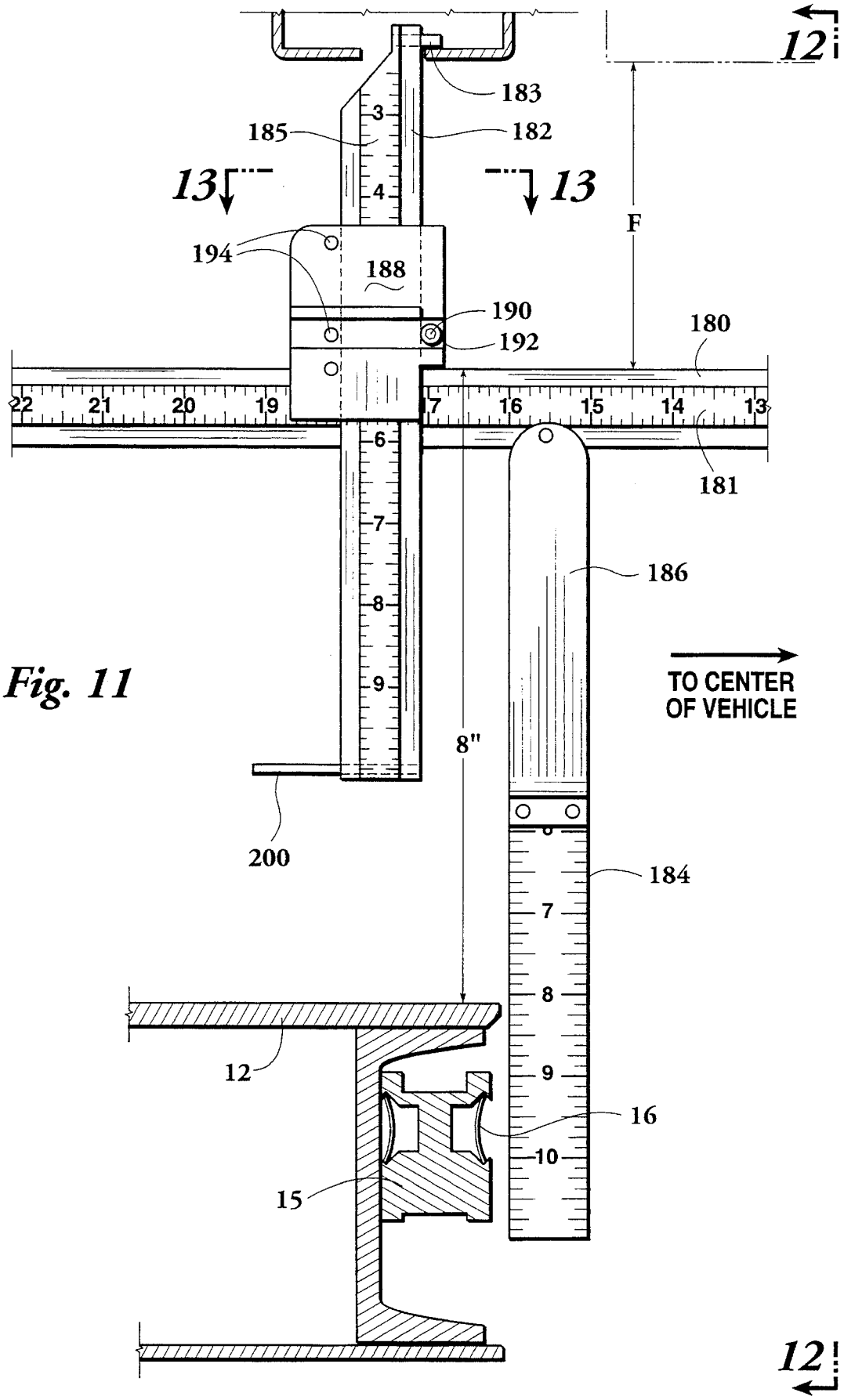
FIG. 11 represents a partial front view of a modified centerline gauge for use with this invention.
Figure 12:
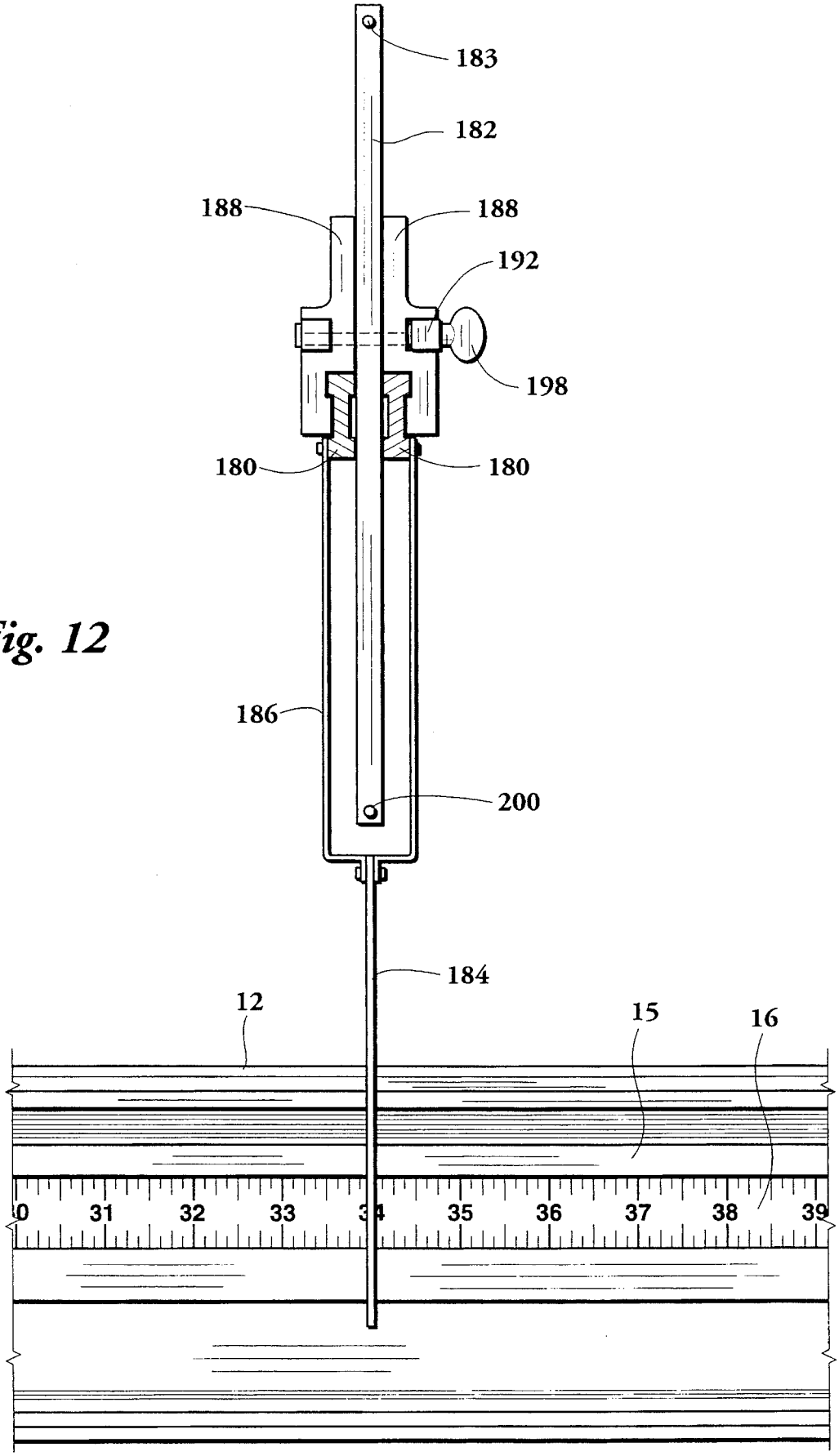
FIG. 12 is a side plan view of the gauge of FIG. 11 taken along the line 12—12 of FIG. 11.
Figure 13:
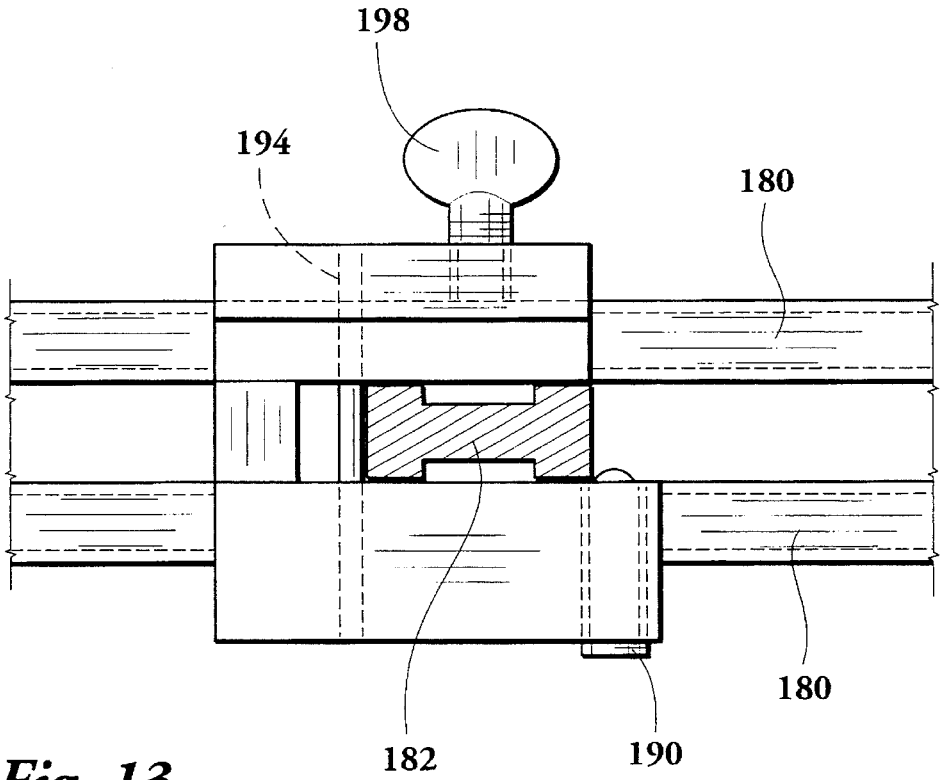
FIG. 13 is a sectional view taken along the line 13—13 of FIG. 11.
Figure 14:
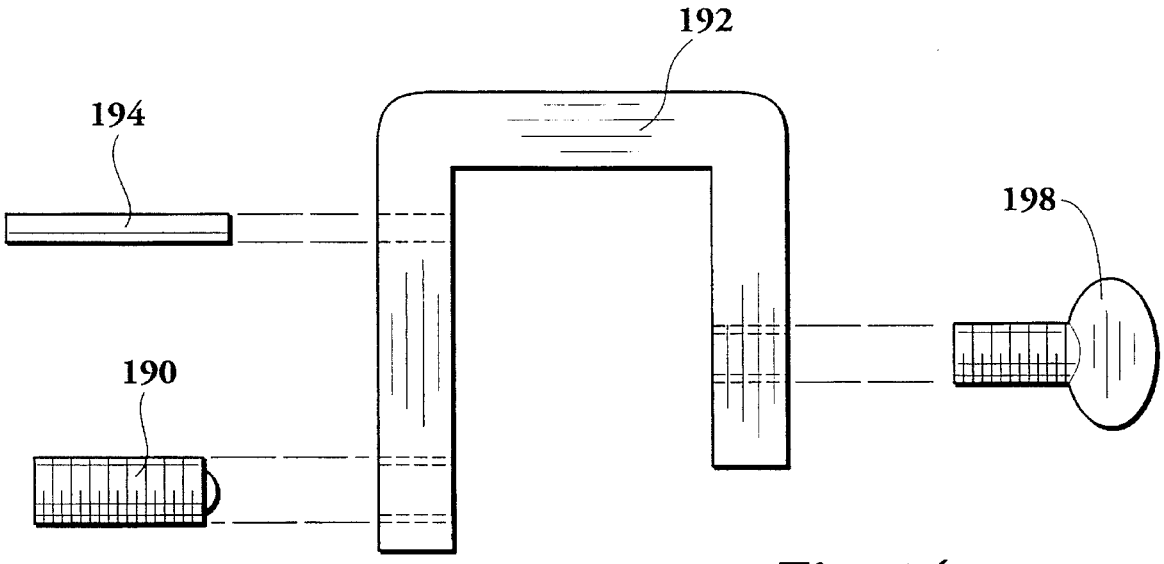
FIG. 14 is an exploded view of the U-shaped clamp used to retain the measuring parts to the centerline horizontal bar.

Another form of centering gauge is shown in FIGS. 11–14. Horizontal arm or bar 180 with measuring scale 181 depends from the vehicle frame using vertical measuring arm 182. A sight pin 200 extends from the bottom of arm 182. Pin 183 holds the arm 182 in a fixturing hole which is to be measured. The arm 182 has measuring indicia on scale 185 and interconnects with centerline gauge arm 180 by means of brackets 188. The brackets are retained together about arm 182 and bar 180 using U-shaped clamp 192 (see FIG. 14) and adjustment screw 198. A spring loaded ball detent 190 threaded in one leg of clamp 192 holds scale 182 squarely and firmly against spaced roll pins 194 while the scale is being adjusted for use, prior to clamping. As shown in FIGS. 11 and 12, a removable hanging scale 184 will provide measurements from the fixturing hole to the top of the treadway 12 from the vehicle. This measurement is important to the repair process. The pendulum like scale 184 is pivotal about pivot pins 187. The measurements are to coincide with the original specifications. For example, referring to FIG. 1, dimension F from the datum line or plans, which in this case is now the treadway 12, should read 4 and 11/16 inches (12 cm) when arm or bar 180 is horizontal and perfectly centered. Any misalignments will cause these measurements to be askew. For example, if there is transverse, i.e., sideways damage, the arm 184 will not hang perpendicular as shown. This will tell the technician the amount of correction needed.

In use, vertical arm 182 and its bracket 188 is attached to arm 180 at the correct distance from the centerline that coincides with, for example, datum point F, and hung at the fixturing station that is preferably undamaged. Referring to FIG. 1A that distance is 15 and 9/16 inches (45 cm) from the centerline of the vehicle. The opposition bracket 188 and its scale 182 are then loosely attached to the other centerline gauge arm 180 and then connected to the opposite fixturing hole. Any correction and the amount is now evident by reading the scales on 180 and 182. Scale 184 will tell of vertical and sideways damage. On other use of the system of FIGS. 11–14 is to indicate if the vehicle is centered on the treadway, i.e., the longitudinal centerline of the vehicle coinciding with the longitudinal centerline of the frame machine. This is best accomplished by positioning the gauge assembly at undamaged positions on the vehicle.

In use, relative to fixturing hole located at "F" the device of FIGS. 11–14 will indicate via bar 180 and scale 181 the position relative to the centerline of the vehicle. Next it will provide an indication of the "F" dimension, in this case 4 and 11/16 inches (12 cm). In many instances, it is desirable to know the total distance from the platform horizontal datum plane to any other of the fixturing locations from the chart without replacing the system of FIGS. 11–14. In this case, the distance is the sum of 4 and 11/16 inches (12 cm) and 8 inches (20.05 cm) or 12 and 11/16 inches (35 cm). The technician can then, with a standard tape measure set at the total distance, or adjusted to other fixturing dimension, check the entire vehicle. For example, if the operator wants to check the station or fixture at "J" or "K", he would add 8 inches (20.05 cm) to the 4 inchex (10.025 cm). Thus, the horizontal bar 180 becomes the actual datum line 30 (FIG. 1) while the treadways 12 and 14 become the adjusted datum line.

What is claimed is:

1. Apparatus for indicating the extent of damage to a vehicle relative to the original manufacturer's specification comprising:

a platform system having spaced treadways to receive said damaged vehicle;

a longitudinal measuring tape attached to each said treadway;

a lower measuring crossbar transversely moveable along said platform system to a measuring position, said measuring crossbar having measuring indicia thereon, means to clamp said measuring crossbar to said platform system, said means to clamp including a peep opening and sight marker for aligning said lower measuring bar at said measuring position and for reading measurements on one of said longitudinal measuring tapes;

an upper measuring crossbar having measuring indicia thereon;

a plurality of vertical datum scales connectable to said vehicle at a fixturing location relative to said measuring position;

brackets having means to connect to said vertical datum scales and having means to connect to said upper measuring bar whereby said upper measuring bar will represent a fixed datum plane by which alignment or misalignment of each said fixturing location relative to the original manufacturer's specification can be compared; and indicator pins vertically moveable in each bracket, each said pin being of a length indicative of a true distance of a respective said fixturing location from said fixed datum plane as per the manufacturer's specification.

2. Apparatus of claim 1 including a center line pin located and depending from said upper measuring bar.

3. Apparatus of claim 1 wherein said lower measuring crossbar includes clip-on target means positionable relative to said indicator pins.

4. Apparatus of claim 2 wherein said lower measuring crossbar includes clip-on target means positionable relative to said indicator pins.

5. Apparatus of claim 1 including means to position said vehicle on said treadways such that a longitudinal centerline of said vehicle is aligned with a longitudinal centerline of said platform system.

* * * * *